US009313846B2

(12) United States Patent
Chen et al.

(10) Patent No.: US 9,313,846 B2
(45) Date of Patent: Apr. 12, 2016

(54) DRIVER FOR TWO OR MORE PARALLEL LED LIGHT STRINGS

(75) Inventors: Wu Chen, Nanjing (CN); Shu Yuen Ron Hui, Shatin (HK)

(73) Assignee: City University of Hong Kong, Hong Kong (HK)

( * ) Notice: Subject to any disclaimer, the term of this patent is extended or adjusted under 35 U.S.C. 154(b) by 230 days.

(21) Appl. No.: 13/883,102

(22) PCT Filed: Nov. 5, 2010

(86) PCT No.: PCT/IB2010/002816

§ 371 (c)(1),
(2), (4) Date: Jul. 18, 2013

(87) PCT Pub. No.: WO2012/059778

PCT Pub. Date: May 10, 2012

(65) Prior Publication Data

US 2013/0293126 A1 Nov. 7, 2013

(51) Int. Cl.
*H05B 33/08* (2006.01)

(52) U.S. Cl.
CPC ..... *H05B 33/083* (2013.01); *H05B 33/0815* (2013.01); *H05B 33/0827* (2013.01)

(58) Field of Classification Search
CPC ..... A47G 33/0809; A47G 33/0818; A47G 33/00; F21S 4/001; F21S 4/00; H05B 33/083; H05B 33/0815; H05B 33/0827; H02M 3/00; H02M 3/335; H02M 3/33507; H02M 3/33523; H02M 3/33561; H02M 3/33576
USPC ..... 315/186, 224; 363/21, 21.011
See application file for complete search history.

(56) References Cited

U.S. PATENT DOCUMENTS

| | | | | |
|---|---|---|---|---|
| 2004/0135522 | A1* | 7/2004 | Berman et al. | 315/291 |
| 2004/0218319 | A1* | 11/2004 | Sae-Ueng et al. | 361/18 |
| 2006/0001381 | A1* | 1/2006 | Robinson et al. | 315/185 R |
| 2006/0208719 | A1* | 9/2006 | Librizzi | 323/288 |

* cited by examiner

*Primary Examiner* — John Poos
*Assistant Examiner* — David Mattison
(74) *Attorney, Agent, or Firm* — Renner Kenner Greive Bobak Taylor & Weber

(57) ABSTRACT

An LED driver for a plurality of LED light strings has a common node and a plurality of driver output nodes for connection of a plurality of LED light strings. A master power circuit is provided and has a master output connected with the common node. A plurality of slave power circuits are provided which each have a slave output connected with a respective one of the driver output nodes.

13 Claims, 11 Drawing Sheets

DRIVER FOR TWO OR MORE PARALLEL LED LIGHT STRINGS

FIELD OF THE INVENTION

The present invention related to LED driver circuits, and in particular to driver circuits for parallel connected LED light strings and a method of driving parallel LED light strings.

BACKGROUND OF THE INVENTION

Light emitting diodes (LEDs) have been gaining wide spread applications in liquid display, signage and general-purpose lightings due to the rapid progress in the solid-state lighting technology. Compared with existing conventional lighting sources such as incandescent lamps and fluorescent lamps, LEDs have relatively longer operational lifetime in the range of 80,000-100,000 hours attributing to no high-field sputtering of filament. LEDs available in the market are now encapsulated with less glass, which significantly improves their reliability and safety to the handler. Free of toxic mercury, LED can be disposed safely at the end of its lifetime. Other advantageous features such as flicker free, smooth dimming, low-voltage operation and good color rendering property make LED an emerging technology that may dominate the lighting market in the near future.

The general photo-electro-thermal (PET) theory points out that the device level multichip design with low-power chips offers advantageous features over single-chip high-power design in terms of higher efficacy and lower junction temperature. Similarly, on the system level, a distributed LED system based on a plurality of relatively low-power LEDs can have similar advantages over a concentrated system consisting of a small number of high-power LEDs for the same system power. Since LEDs are current-driven devices and its luminous intensity is directly related to the forward current applied, when driving multiple LEDs, a series connection structure is superior to a parallel one because all LEDs in the series string can operate at the same current without current sharing and chromaticity variation issues. However, the number of LEDs connected in series is highly limited by the output voltage provided by the power supply and therefore the use of parallel LED strings has been acrimony practice particularly for high power applications (say >25 W). Such parallel LED strings arrangement leads to current imbalance issue because of the manufacturing tolerance, aging and temperature variations in LEDs, resulting in variations in the luminous intensity and color. Furthermore, one or more LED strings may exceed its absolute maximum rating current even though the average current of each LED string is less than the rating current when parallel LED strings are used without current sharing means.

There are several current sharing methods for driving multistring LEDs connected in parallel. A straightforward approach is to add a ballast resistor in series with each LED string to minimize current differences. This approach is very simple; however, it suffers from poor operating efficiency due to the significant power losses dissipated on the added ballast resistors. A lossless capacitor can be used to replace the loss ballast resistor to reduce the unnecessary loss when the LEDs are driven with AC source or coupled with rectifier. The main drawback of these methods is that the forward current of each LED string cannot be controlled precisely. Currently, a linear current regulator for each string has been employed to ensure good current sharing effect, at the expense of considerable power loss on the current regulator. Another approach is to set up a separate voltage source for each LEDs string. A modular power converter architecture based on parallel or series input connected converters with separate LED string loads can be used. Each LED string current is independently sensed and controlled to follow the same reference. Without loss ballast resistor or linear current regulator, the two LED driver architectures have relatively higher conversion efficiency. However, the architectures are complex and expensive because each LED string needs a set of main circuit and controller.

SUMMARY OF THE INVENTION

The current invention provides an LED driver with a common master power converter and parallel cascaded slave power converters for driving a plurality of parallel LED strings. A master power converter is used to provide the major part of the driver voltage and a plurality of slave converter modules with voltage regulation provide a residual balancing voltage for controlling each LED string current respectively. The master power converter may be PWM controlled for dimming the LED strings. The master power converter should provide a majority portion of the overall output voltage whilst the slave power converter provide the remaining minority portion of such voltage. Preferably, although not essentially, the master power converter provides ninety-percent (90%) of the nominal supply voltage for the LED strings. The remaining ten-percent (10%) of the voltage to each LED string is provided by one of the slave power converters. The slave power converters regulate the residual voltage to balance the current in each of the parallel LED strings. The slave converters can use either semiconductor switches such as power MOSFETs or magnetic amplifiers for switching control, The invention also provide a method of driving two or more parallel LED strings by providing a first portion of the supply voltage for the strings from a single master power converter circuit and second residual portions of the voltage for each LED string from separate slave power converters. A separate slave power converter is used for each LED string and the method includes separately regulating the residual voltage portions to balance the current in each LED string.

Accordingly, there is disclosed herein an LED driver the driver comprising a common node, a plurality of driver output nodes, wherein in use a plurality of LED light strings is connected between respective ones of the driver output nodes and the common node, a master power circuit having a master output connected with the common node, and a plurality of slave power circuits, each slave power circuit having a slave output connected with a respective one of the driver output nodes.

There is also disclosed herein an LED driver the driver comprising a common node, at least two output nodes, a master power circuit generating a master voltage output connected with the common node, at least two slave power circuits, each slave power circuit generating a regulated voltage output, the regulated voltage outputs connected with respective ones of the output nodes, and wherein a driver voltage between the common node and one of the driver output nodes comprising a sum of the master voltage and a respective one of the slave voltages.

Each slave output may be connected in series with the master output. The master power circuit and slave power circuits are preferably arranged so that the master voltage is greater than any one of the slave voltages, and more preferably approximately nine times greater than any one of the slave voltages although the skilled addressee will appreciate that in a preferred aspect the secondary circuits are separately regulated and so the ratio of voltages may vary in use.

The master power circuit and/or slave power circuits are preferably switch mode power supplies. More preferably the power circuits comprises a forward converter having a transformer with first and second secondary windings, and with the master power circuit connected with the first secondary winding and each of the salve power circuits connected with the second secondary winding. Each slave power circuits may have a semiconductor switch (such as a power MOSFET) or a magnetic amplifier and a feed back circuit for separately regulating each of the slave power circuits. A primary circuit is connected with a primary winding of the transformer and includes a PWM controlled switch for regulating power to the primary winding.

Further aspects of the invention will become apparent from the following description, which is given by way of example only to illustrate particular embodiments of the invention.

BRIEF DESCRIPTION OF THE DRAWINGS

The invention will now be described with reference to the attached drawings in which.

DESCRIPTION OF PARTICULAR EMBODIMENTS OF THE INVENTION

Before any embodiments of the invention are described in detail, it is to be understood that the invention is not limited in its application to the details of arrangements set forth in the following description or illustrated in the accompanying drawings. The invention is capable of other embodiments and of being practiced or of being carried out in various ways. Also, it is to be understood that the phraseology and terminology used herein are for the purpose of description and should not be regarded as limiting.

Figure 1A:
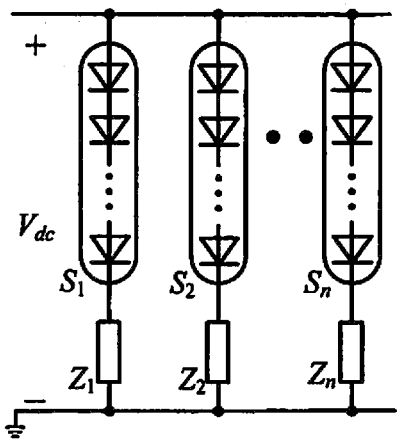
Figure 1a (prior art)
FIGS. 1*a*, 1*b* and 1*c* are schematic illustrations of three prior art approaches for reducing current imbalance in parallel LED strings.
Figure 1B:
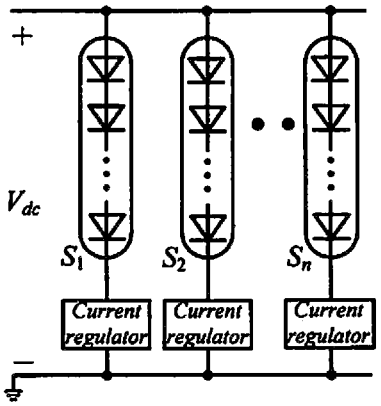
Figure 1b (prior art)
Figure 1C:
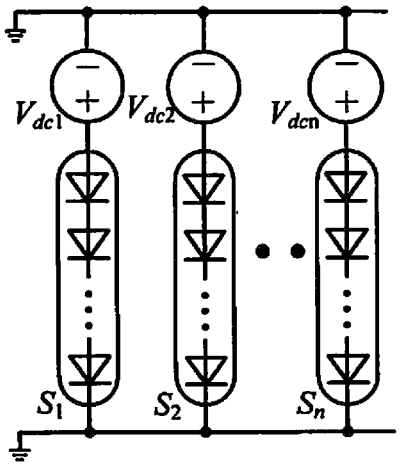
Figure 1c (prior art)
Figure 2A:
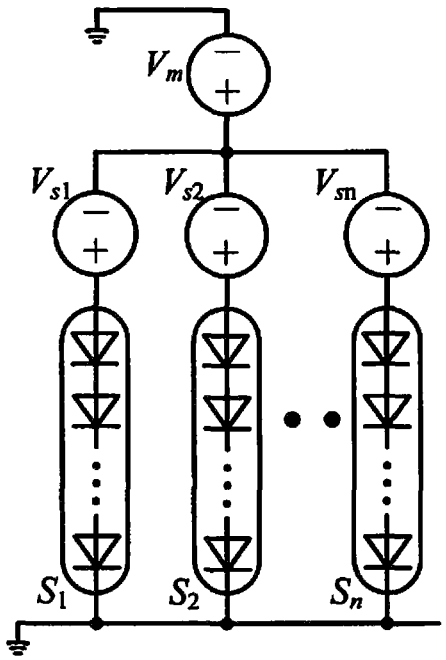
FIG. 2*a* is a schematic illustration of an LED driver according to the present invention.
Figure 2B:
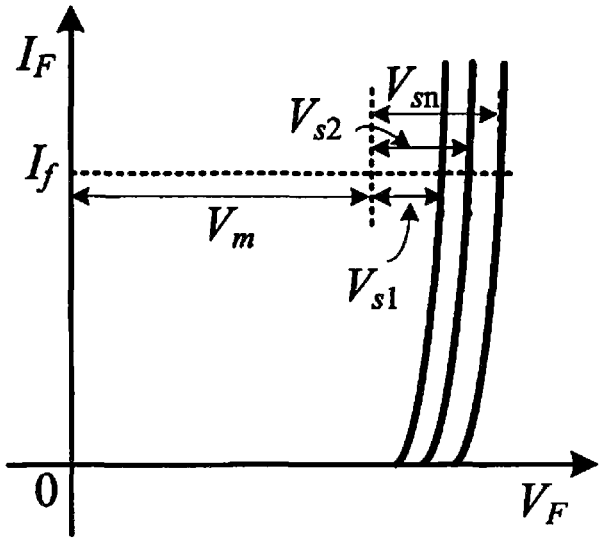
FIG. 2*b* is a graphical illustration of voltage outputs of the LED driver

The invention provides an driver for parallel LED strings with a "common" master voltage source (Vm) for all LED strings and a separate slave voltage source (Vs1 to Vsn) for each LED string (S1, S2 . . . Sn) for current regulation as shown in FIG. 2*a*. Referring to FIGS. 2*a* and 2*b*, the majority of power consumed in each string is fed by the "master" voltage source (Vm), whilst the corresponding slave voltage sources (Vs1, Vs2 . . . Vsn) are used to regulate the current in each LED string (S1, S2 . . . Sn) for current balancing. To avoid larger power losses, all the master and slave dc sources should be switch-mode converters. This is very important for LEDs with wide device parameter tolerances. For example, the forward voltages of 8 LED strings at 45 mA may vary from 21.9 V to 31.7 V. If linear current regulators are used, the voltage drop across the linear current regulator of the string with minimum forward voltage will be up to 9.8 V, and the power loss in the current regulator is unacceptable if the forward current is large. For example, a typical string current of 0.3 A will lead to about power loss of 3 W in each string. With the proposed LED driver structure, a 20V master source common for all 8 strings and a separate low-voltage slave voltage source covering the voltage difference among the parallel LED strings can be constructed in each string. Thus, the majority of the power is provided by the master source and only the remaining power is provided by the corresponding slave source.

Various topologies with independent multiple outputs can be used in the invention. However for commercial application the driver should preferably meet the following technical requirements.

1) Electrical isolation: electrical isolation is necessary between the master source and the slave sources because their terminals cannot share the same ground. However, it is not necessary to carry out electrical isolation among the slave sources.
2) Regulated outputs; the voltage across the LED string should be regulated to adapt to different forward currents and ambient temperature. Hence, independently and precisely regulated multiple outputs are preferable.
3) Modularity: it is preferably that the topology is easily expanded and so a modular approach is preferred.
4) Power distribution: the majority of the LED power should be provided by the master source and the remaining power provided by the slave sources. The circuit implementation should achieve such power distribution.

Figure 3:
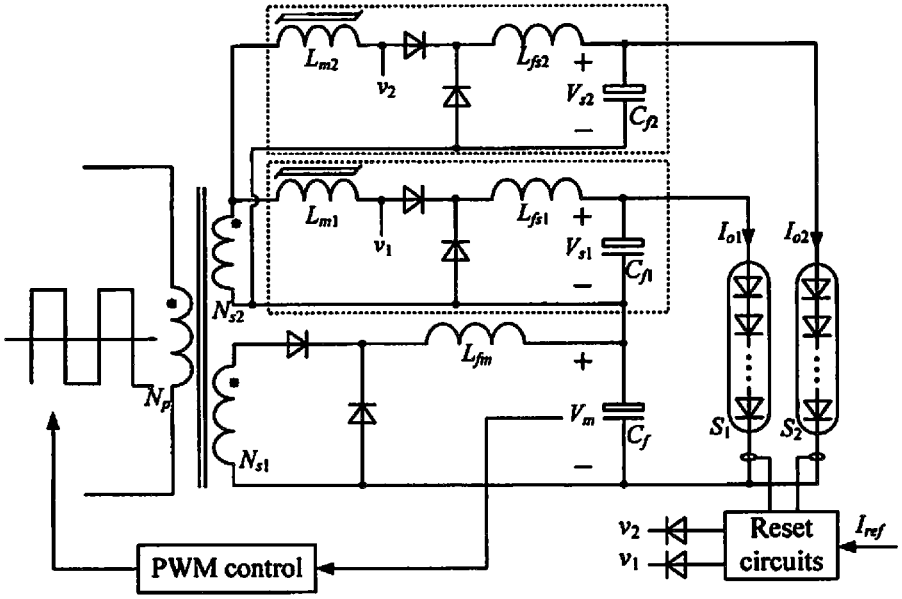
FIG. 3 is a circuit diagram of the LED driver.

Based on these considerations, a first embodiment of an LED driver topology with magnetic amplifier (mag-amp) post-regulators is illustrated in FIG. 3. A mag-amp post-regulator topology has high efficiency, high stability, high power density, simple control, and low electromagnetic interference. It should however be noted that standard switched mode power regulators based on the use of power semiconductor switch (such as MOSFETs instead of magnetic amplifiers) can also be used for the slave post regulators in FIG. 3. Only two secondary windings Ns1 and Ns2 of the transformer are required to generate a plurality (more than two) of outputs. One secondary winding, Ns1, output is used for the master source Vm, which is PWM controlled by a power converter on the primary side. The other secondary winding, Ns2, output is used to generate multiple slave sources Vs1, Vs2 . . . , Vsn (only two slave sources are shown in FIG. 3, but more may be used for more LED strings) based on separate mag-amp regulators Lm1, Lm2 with feedback loop v1, v2 through sensing LED forward current. It is worthwhile to note that two advantages of the arrangement of the invention are firstly that only two secondary windings are needed to generate multiple outputs, thus resulting in simpler transformer structure, lower production cost and less leakage inductance, and secondly, each mag-amp regulator Lm1, Lm2 is used to handle only a small portion of the power in each LED string therefore, the size of the mag-amp core is much smaller and its power loss is low.

The mag-amp regulators provide power regulation functions for a portion of the power in each LED string. If the string current Io1 is larger than a reference current Iref, then the duration of the blocking time of the mag-amp inductor Lm1 will be increased by adjusting the output of the reset circuit, leading to the decline of the Vs1, and the subsequent reduction of Io1 to follow Iref. As shown in FIG. 3, it can be seen that the power provided for each LED string is composed of two parts, the master source and separate slave source. If the forward voltage drop of a LED string is constant, there are countless distribution combinations between the master source and the slave one. Hence determining how to find the optimal distribution will be qualitatively analyzed here.

A. Power Distribution

Firstly, the voltage of the master source must be lower than all the forward voltage drops of the LED strings under whole operating conditions because the master source should provide the majority (but not all) of the power for all the LED strings, i.e., Vm<Vled_min. The slave sources should be able to adjust the part of the voltage across LED strings to regulate their forward currents.

Secondly, the lower the master source is, the higher the slave source becomes because the sum of them should be equal to the voltage across the entire LED string. In the extreme case, if the voltage of the master source is equal to zero, the proposed circuit reduces to the conventional converter with multiple outputs, in which case each LED string is fully powered by a single source. Two disadvantages arise from this extreme case. The voltage stress of the rectifier diodes in each source will be increased significantly and therefore high-voltage diodes with relatively high voltage drop have to be used. The second disadvantage is that a larger output filter inductor will be needed in each source to meet the output current ripple requirement. Besides, the power losses on the magnetic-amplifier will be increased because it has to block a voltage high enough for the entire LED string. In this invention, the common power supply provides the main voltage for all LED strings. Thus, power diodes with low voltage ratings and low forward voltage drop such as Schottky diodes and smaller output filter inductors can be chosen for the slave source.

In this analysis, we assume that all the LED strings share the same current and have the same forward voltage drop VF, and the sum of all string currents is IF. All the output filter inductor current are assumed to have the same ripple current factor γ. For the case where each LED string is fully powered by a single source, the required output filter inductor in each output is $$L_{fpi} = \frac{V_F(1-D)T_s}{\gamma \cdot I_F/n} = \frac{V_F(1-D)T_s}{\Delta I_{F_slave}} = \alpha \quad (i = 1, \ldots n) \tag{1}$$

where D is the duty cycle of the voltage pulse in secondary winding, Ts is the switching period of the voltage pulse in secondary winding, and n is the number of LED strings. For convenience, the value of $$\frac{V_F(1-D)T_s}{\Delta I_{F_slave}}$$

in (1) is defined as α.

Then for the proposed driver, the required output filter inductor for the master source is $$L_{fm} = \frac{V_m(1-D)T_s}{\gamma I_F} = \frac{V_m}{n \cdot V_F} \cdot \alpha \tag{2}$$

The required output filter inductor in each slave source is $$L_{fsi} = \frac{(V_F - V_m)(1-D)T_s}{\gamma \cdot I_F/n} = \frac{V_F - V_m}{V_F} \cdot \alpha \quad (i = 1, \ldots n) \tag{3}$$

Figure 4:
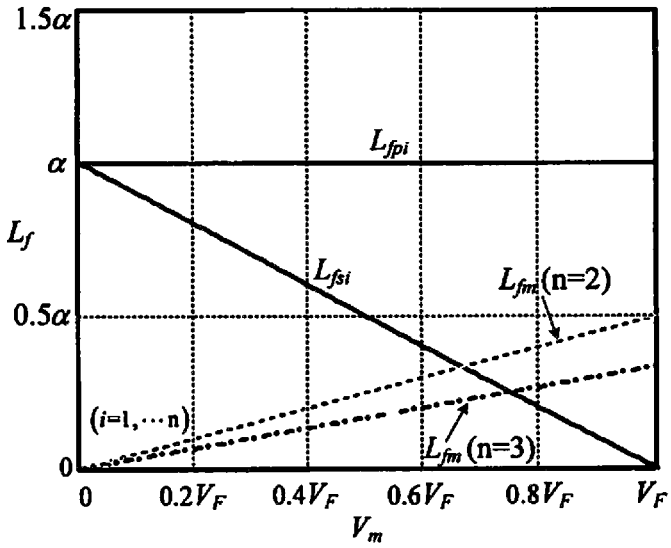
FIG. 4 shows curves of Lf versus Vm for the LED driver.

Then we can obtain the curves of Lf versus Vm, as shown in FIG. 4. If the load has three LED strings, i.e., n=3, if we set Vm=0.9 VF. (i.e. the common power supply provides 90% of the output voltage), then one inductor for Vm with 0.3α and three inductors for Vs1 to Vs3 with 0.1α each are needed in the proposed driver.

The core loss in the mag-amp core is $$P_{core} = (9.93 \times 10^{-6}) \cdot (f^{1.57}) \cdot (B^{1.70}) \tag{4}$$

Equation (4) indicates that the core loss is proportional to the magnetic flux density. In our proposal, the voltage of the slave source that uses the mag-amp core is much lower than the full voltage across the LED string. Therefore, (4) confirms theoretically that mag-amp power loss in this proposal is also reduced.

B. Dimming Methods

Traditionally, there are two kinds of dimming techniques for driving LEDs: amplitude mode and PWM mode. However, PWM dimming methods have been better received for high-performance applications such as display panels because the current level and hence the color temperature of the LED can be maintained, although amplitude mode is acceptable for general public lighting applications.

Figure 5:
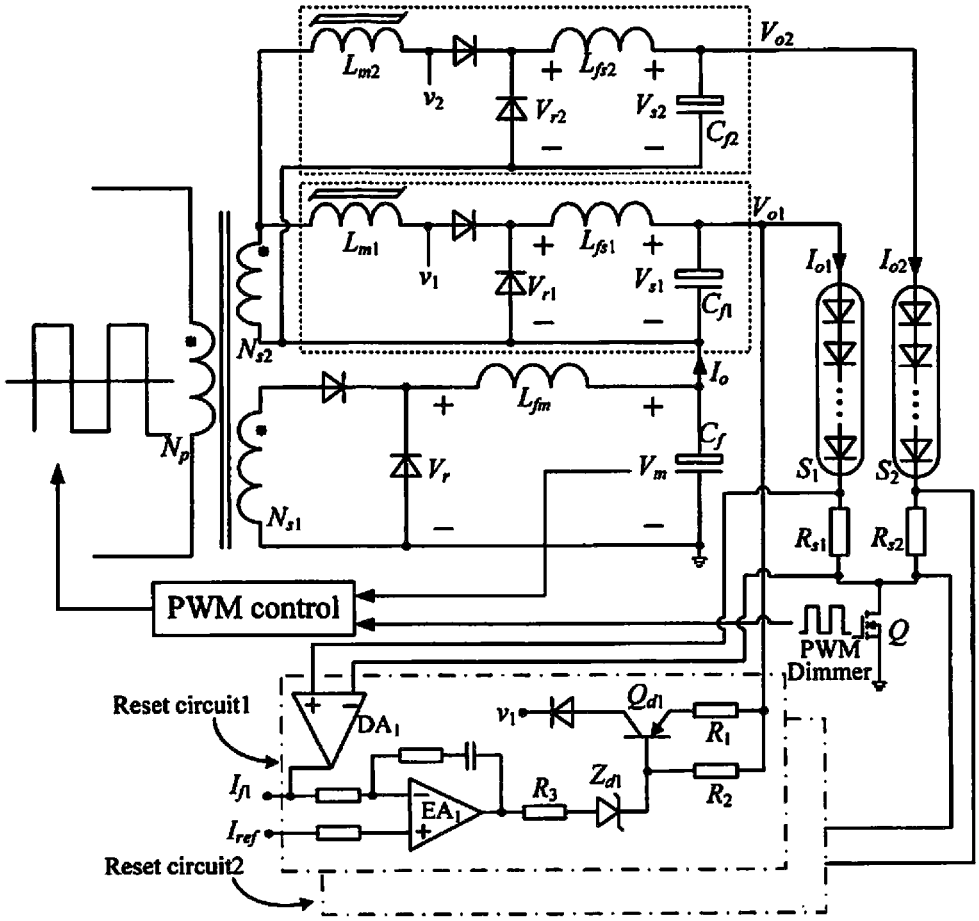
FIG. 5 is a circuit diagram of a second embodiment of an LED driver according to the present invention, with PWM dimming.

In the invention, dimming can be achieved through conventional PWM scheme and a phase-shift PWM (PSPWM) scheme. The circuit diagram of the proposed LED driver system with conventional PWM dimming function is shown in FIG. 5 (only two LED strings are shown), in which Rs1 and Rs2 are current sensing resistors for LED string S1 and S2, respectively, Q is the PWM dimming switch, the circuit inside the dotted box is the reset circuit for mag-amp. Unlike the conventional PWM dimming method used with linear current regulators, only one MOSFET (dimming switch) is needed for all LED strings in this proposal and it is operated not in the linear ohmic region but in the saturation region. Hence, the conduction power losses in the dimming process can be reduced. However, differential amplifiers (DA1) are needed to sense the LED current signals because all the current sensing resistors do not share the common ground (as only one dimming switch Q is used). The sensed current signal is compared with Iref to regulate the reset current of the mag-amp. The special use of the zener diode Zd1 is to act as a voltage level shifter because the multiple output voltages of the converter may not be the same voltage level of the error amplifier. During the time interval when Q is tuned off, the high-frequency switching operation of the primary main switches can be disabled to further reduce the switching loss. If the dimming switch Q is shorted, then amplitude mode dimming can be achieved by regulating the current reference Iref.

Figure 6:
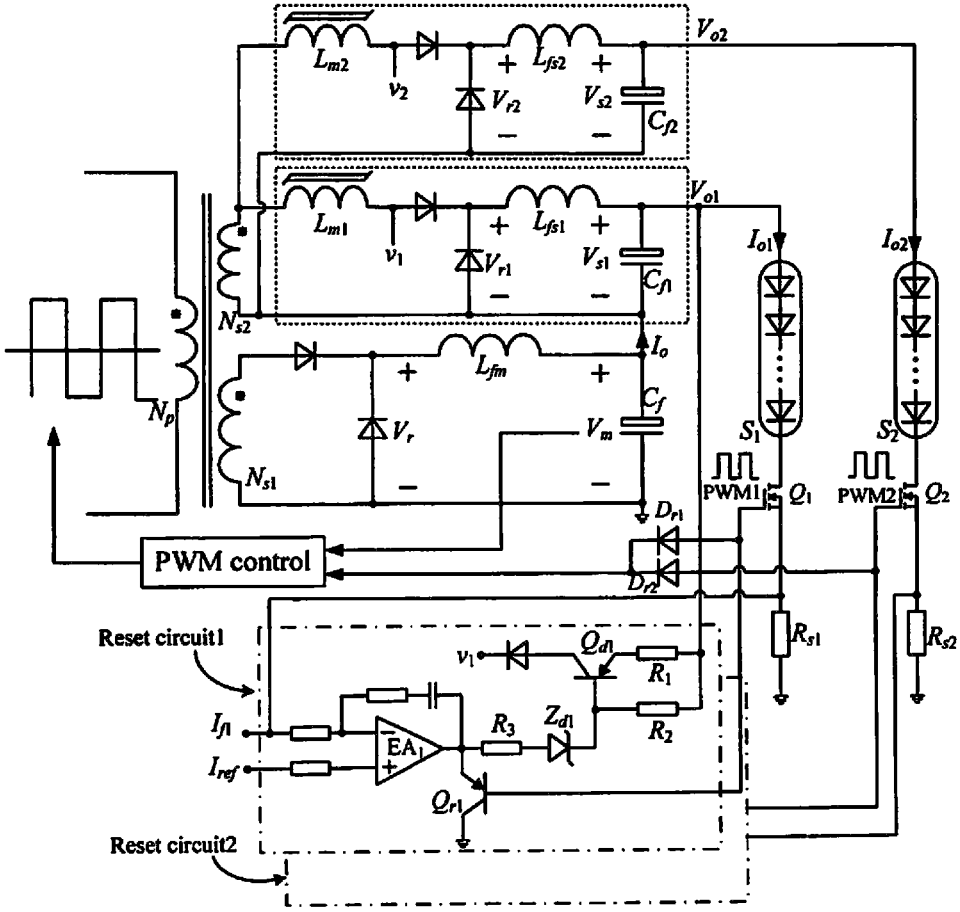
FIG. 6 is a circuit diagram of a third embodiment of an LED driver according to the present invention, with PSPWM dimming.

To avoid the drawback of the conventional PWM dimming such as large pulsating input/output current and degraded EMI performance, PSPWM dimming function can be adopted. The proposed LED driver system with PSPWM dimming function is shown in FIG. 6, in which one dimming switch is used for each LED string. In the reset circuit of FIG. 6, a PNP transistor (Qr1) is added to the output of the error amplifier. Its role is explained as follows. Taking LED string S1 as an example. During the time interval when Q1 is turned off, the sensed current is zero and the output voltage of EA1 is high if no Qr1 is used. This situation will result in a reset current too small for the saturable reactor Lm1, and Lm1 will lose its mag-amp function and Vs1 will rise far from its desired value. That is, Vs1 is out of control. When Qr1 is added, the output voltage of EA1 is almost zero, then the reset current for Lm1 will increase to block the voltage pulse from the secondary winding Ns2. Hence the saturable reactor must be designed to have the ability to withstand the entire volt-second product of the input waveform. In the case where all the PWM dimming signals are simultaneously low, the main switches in the primary side of the transformer can be turned off to reduce the switching losses. All the PWM dimming signals are OR-ed via Dr1 through Drn to detect the signal.

The performance of the proposed LED driver was verified by a prototype with a 120 kHz single-ended forward converter with tertiary transformer reset winding operating from a voltage source in 20-30 V. Three parallel strings of CREE cool white LEDs (model number: XREWHT-L1-WG-Q5-0-04) with six LEDs connected in series in each string are used to evaluate the performance of the proposed LED driver. The typical forward voltage of each LED is 3.3 V with 350 mA, and the desired Vm is set as 17 V. The key components of the circuit are listed in Table I. The inductor values are determined by (1)-(3).

TABLE I

| | |
|---|---|
| Primary main switch | IRF540N |
| Turns ratio of transformer | Np:Nr:Ns1:Ns2 = 12:12:24:5 |
| Rectifier of master source | BYW51-200 |
| Rectifier of slave source | 42CTQ030S |
| Filter inductor of master source | 530 μH |
| Filter inductor of slave source | 170 μH |
| PWM controller | SG3525A (120 kHz) |
| Lm1~Lm3 | AMG-12S, 16T |
| Zd1~Zd3 | 1N5349B |
| Qd1~Qd3 | TIP127 |
| EA1~EA3 | LM358 |

Figure 7A:
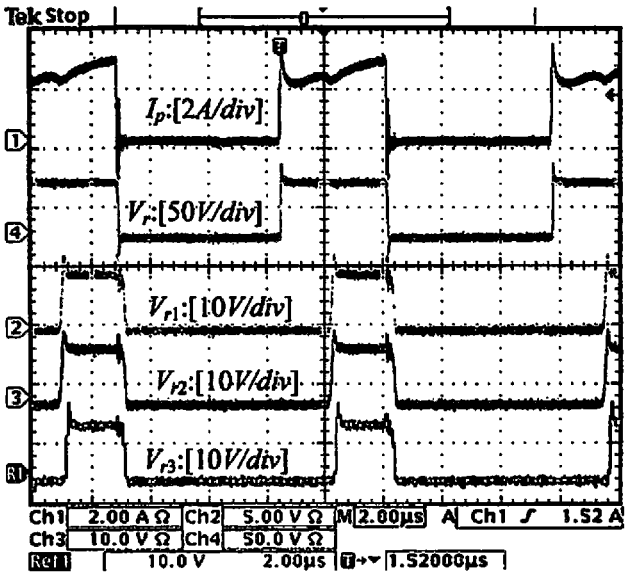
FIG. 7 shows waveforms of the primary switch current Ip and secondary rectifier voltage Vr, Vr1, Vr2 and Vr3 for an example LED driver according to the invention with (a) Matched LED strings and (b) Unmatched LED strings.
Figure 7B:
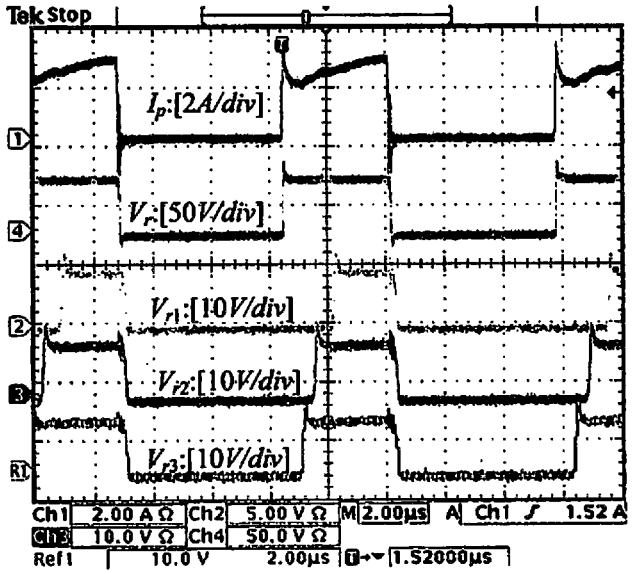
Figure 8A:
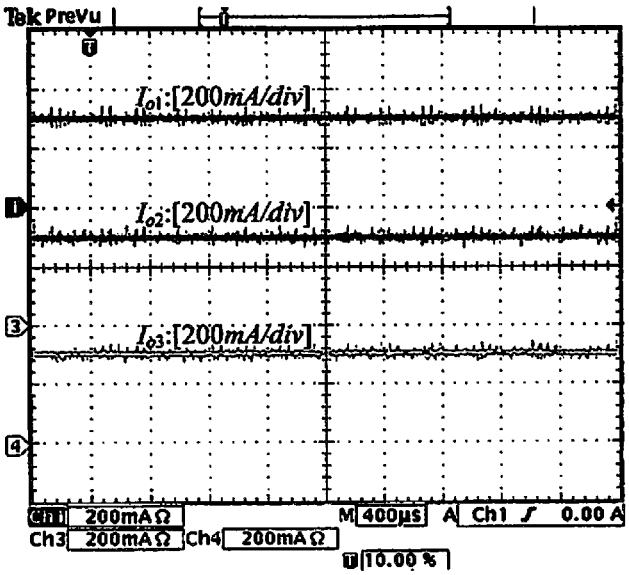
FIG. 8 shows measured LED string current waveforms for an example LED driver according to the invention under (a) 100%, (b) 80%, (c) 50% and (d) 20% conventional PWM dimming operations.
Figure 8B:
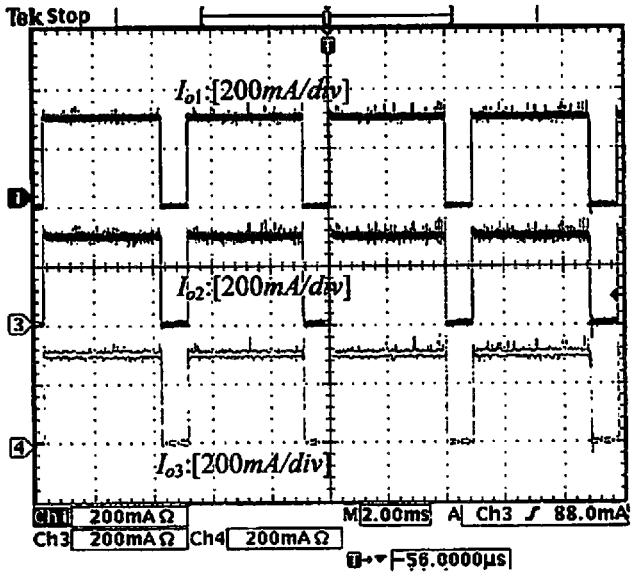
Figure 8C:
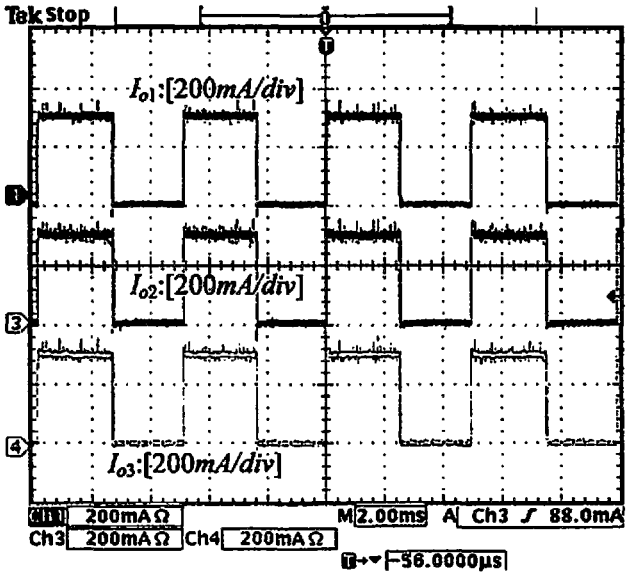
Figure 8D:
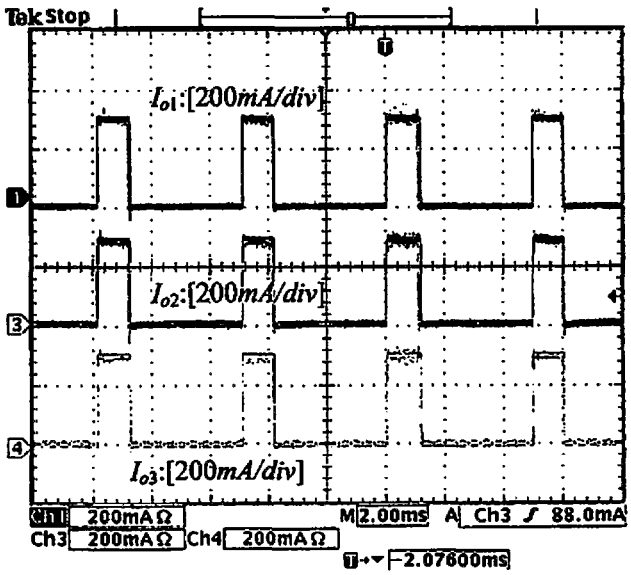

FIG. 7 shows the key waveforms of the LED driver. FIG. 7(*a*) shows the waveforms of the primary switch current Ip and secondary rectifier voltage Vr, Vr1, Vr2 and Vr3. It can be seen that the pulse widths are not identical. The pulse width of Vr3 is slightly shorter than that of Vr1 and Vr2. The measured voltages are Vm=17.06 V, Vs1=1.87V, Vs2=1.88 V, Vs3=1.72 V. In order to demonstrate the ability of the proposed LED driver to adjust the drive voltage for reducing current imbalance, resistors of 2.2Ω and 3.9Ω are added to the 2nd and 3rd LED strings, respectively, so that an exaggerated mismatch situation among the 3 LED strings is created. FIG. 7(*b*) shows the new waveforms under this situation. As expected, the pulse width of Vr3 is widest because the 3rd string has the highest extra resistor; the pulse width of Vr2 is wider than that of Vr1, which remains unchanged. The new measured voltages are Vm=17.06 V, Vs1=1.87V, Vs2=2.52 V, Vs3=2.94 V.

Figure 9A:
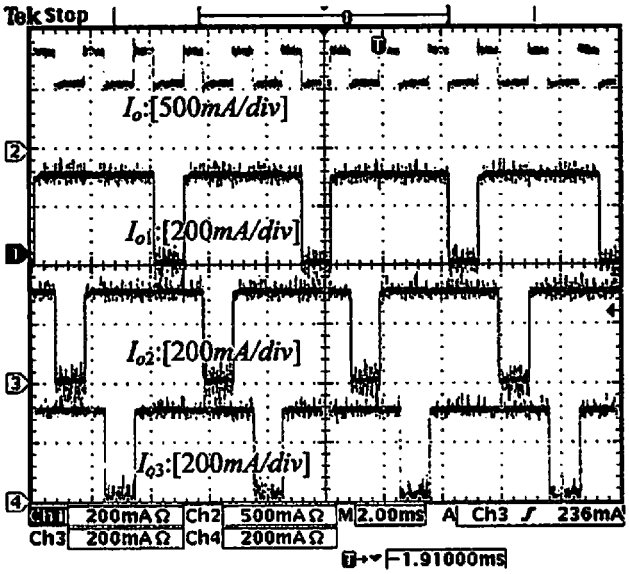
FIG. 9 shows measured LED string current waveforms for an example LED driver according to the invention under (a) 80%, (b) 50% and (c) 20% PSPWM dimming operations.
Figure 9B:
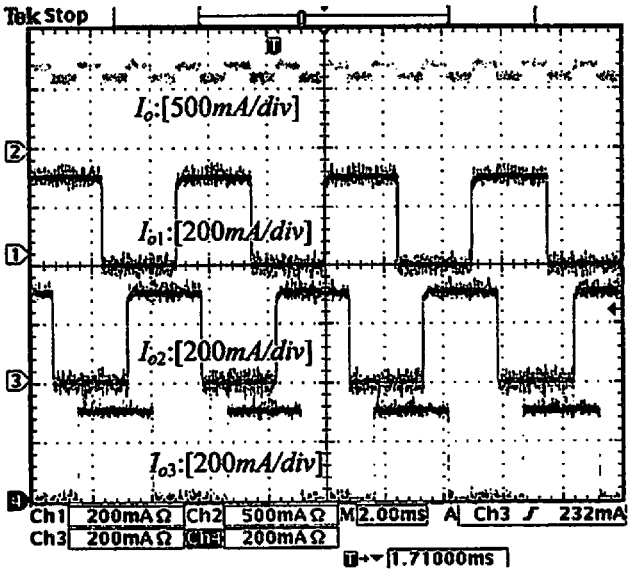
Figure 9C:
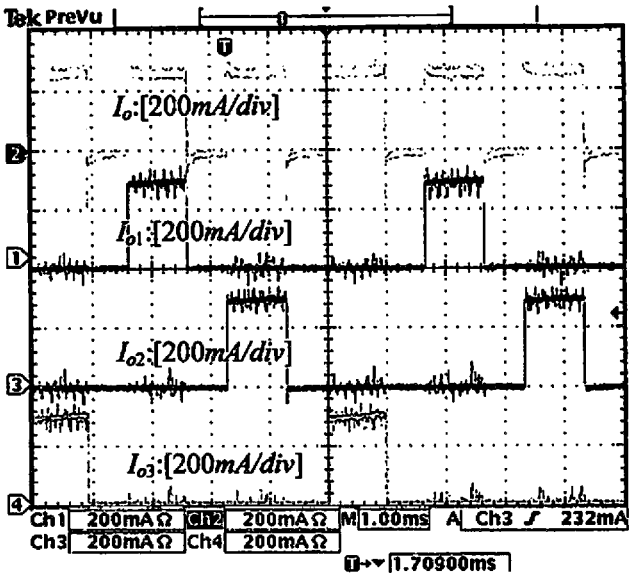

FIG. 8 shows the measured LED string currents with conventional PWM dimming approach (see FIG. 5) under different duty cycles. Identical amplitude of 300 mA can be achieved for the three LED strings under different duty cycles by regulating the voltages of three slave sources, whilst having only one dimming switch. FIG. 9 shows the waveforms of the proposed LED driver under PSPWM dimming approach (see FIG. 6) under different duty cycles. Again, good current balance has been practically achieved under all these conditions.

Figure 10:
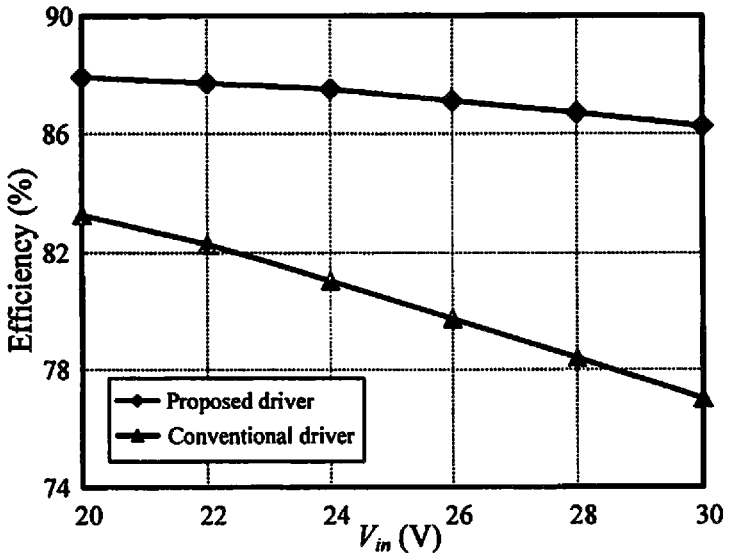
FIG. 10 shows the efficiency comparison between for an example LED driver according to the invention and a prior art multi-output mag-amp regulated driver.

A conventional LED mag-amp regulated driver as described by C.-C. Chen, C.-Y. Wu and T.-F. Wu, "Fast transition current-type burst-mode dimming control for the LED back-light driving system of LCD TV," in Proc. IEEE PESC, 2006, pp. 2949-2955, the entire contents of which is incorporated herein by reference, is built for comparison purpose. FIG. 10 shows the measured overall efficiency of the proposed LED driver and the conventional one under different input voltages. Due to the use of a common power supply and the relative low-power handling requirements of the mag-amp postregulators, a higher energy efficiency has been achieved by the proposed scheme.

Figure 11:
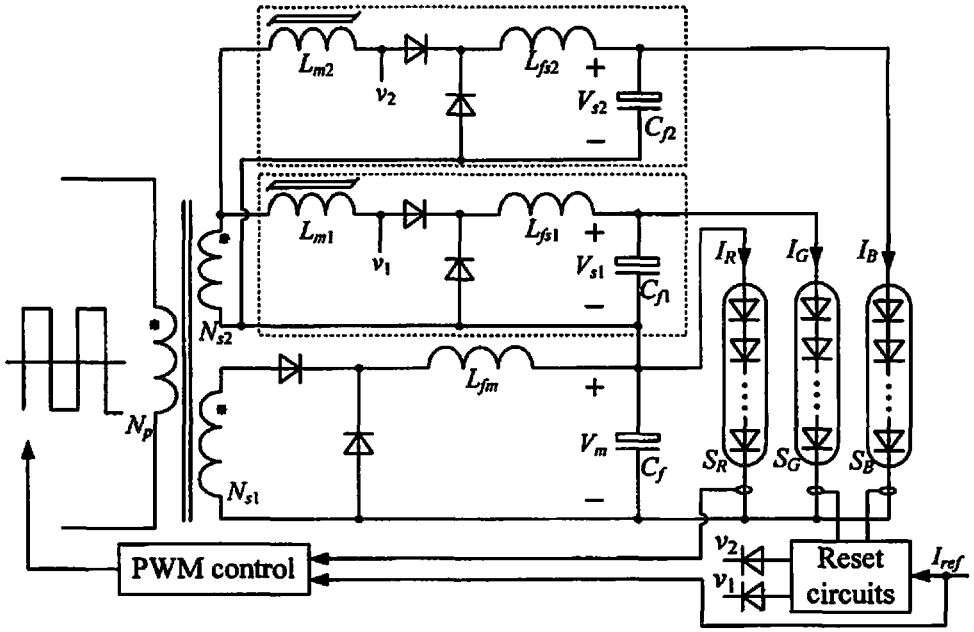
FIG. 11 is a circuit diagram of a third embodiment of an LED driver according to the present invention for use with Red, Green and Blue colour (RGB) LED strings.

For LCD backlight application, the RGB LEDs mixing three color lights to white light are often employed. However, the nominal forward voltages of red, green, and blue LEDs are different. The forward voltage of red LED is lower than those of green and blue ones from the same manufacturer, and the forward voltage of green LED is approximate the same as that of the blue one. In light of these factors, the proposed LED driver is suitable for RGB LED application. The proposed circuit can be used for such application. In FIG. 11, the red LED string is powered by the master source, the green and blue LED strings are powered by the combination of the master source and corresponding slave sources. The currents of green and blue LED strings are separately regulated by corresponding adaptive slave voltage source for current sharing; however, the current of red LED string is just regulated by the master voltage source for current sharing.

What is claimed is:

1. A LED driver for driving a plurality of parallel LED light strings, comprising:

a common master power converter; and a plurality of parallel cascaded slave power converters each electrically connected between the common master power converter and a respective one of the plurality of parallel LED light strings;

wherein, in use, the common master power converter is arranged to provide a major part of a driver voltage for each of the plurality of parallel LED light strings, and each of the plurality of slave power converters are arranged to provide a residue balancing voltage to the respective LED light string; and wherein the plurality of slave power converters are arranged to regulate the residue balancing voltage so as to balance currents in the plurality of parallel LED light strings.

2. The LED driver in accordance with claim 1, wherein the common master power converter is arranged to provide 90% of the voltage for each of the plurality of parallel LED light strings, and each of the plurality of slave power converters is arranged to provide 10% of the voltage for the respective LED light string.

3. The LED driver in accordance with claim 1, further comprising a power converter having a transformer with a primary winding, a first secondary winding and a second secondary winding; wherein the common master power converter is connected with the first secondary winding and each of the plurality of salve power converters are connected with the second secondary winding.

4. The LED driver in accordance with claim 3, further comprising a primary circuit connected with the primary winding of the transformer, the primary circuit includes a pulse width modulation controlled switch for regulating power to the primary winding.

5. The LED driver in accordance with claim 3, wherein the power converter is a flyback converter or a forward converter.

6. The LED driver in accordance with claim 1, wherein the LED driver further comprises a feedback circuit for controlling saturation of at least one of the plurality of slave power converters.

7. The LED driver in accordance with claim 6, wherein the feedback circuit controls saturation of at least one of the plurality of slave power converters through sensing forward currents in the LED light strings.

8. The LED driver in accordance with claim 1, wherein the common master power converter is pulse width modulation controlled for dimming the plurality of LED strings.

9. The LED driver in accordance with claim 1, wherein the plurality of slave power converters are pulse width modulation controlled for dimming the plurality of LED strings.

10. The LED driver in accordance with claim 1, wherein each of the plurality of slave power converters comprises a magnetic amplifier or a power semiconductor switch for regulation or switching control.

11. The LED driver in accordance with claim 1, wherein the common master power converter comprises a switched-mode power supply.

12. The LED driver in accordance with claim 1, wherein the plurality of slave power converters each comprises a switched-mode power supply.

13. A LED driver for driving a plurality of parallel LED light strings, comprising:

a common master power converter; and a plurality of parallel cascaded slave power converters each electrically connected between the common master power converter and a respective one of the plurality of LED light strings;

wherein, in use, the common master power converter is arranged to provide all of a voltage for one of the plurality of parallel LED light strings, and to provide a major part of a driver voltage for each of the remaining plurality of parallel LED light strings, and each of the plurality of slave power converters is arranged to provide a residue balancing voltage to the respective LED light string; and wherein the plurality of slave power converters are arranged to regulate the residue balancing voltage so as to balance currents in the plurality of parallel LED light strings.

* * * * *